US007635293B2

(12) United States Patent
Sun et al.

(10) Patent No.: US 7,635,293 B2
(45) Date of Patent: Dec. 22, 2009

(54) GRINDING MACHINE WITH A LENGTH-ADJUSTABLE DUST COLLECTING STRUCTURE

(75) Inventors: Yung-yung Sun, Dali (TW); Chuan-ching Cheng, Taichung (TW)

(73) Assignee: Storm Pneumtic Tool Co., Ltd., Dali (TW)

( * ) Notice: Subject to any disclaimer, the term of this patent is extended or adjusted under 35 U.S.C. 154(b) by 5 days.

(21) Appl. No.: 12/071,755

(22) Filed: Feb. 26, 2008

(65) Prior Publication Data

US 2009/0215364 A1 Aug. 27, 2009

(51) Int. Cl.
*B24B 23/02* (2006.01)
*B24B 27/08* (2006.01)

(52) U.S. Cl. ..... 451/354; 451/357; 451/358; 451/359; 451/456

(58) Field of Classification Search ..... 15/300.1; 83/440.2, 546; 451/344, 354, 356, 357, 358, 451/359, 451, 452, 455, 456
See application file for complete search history.

(56) References Cited

U.S. PATENT DOCUMENTS 4,151,705 A * 5/1979 Evans ..... 451/301
4,905,420 A * 3/1990 Flachenecker et al. ..... 451/344
5,002,318 A * 3/1991 Witter ..... 285/302
5,319,889 A * 6/1994 Rudolf et al. ..... 451/359
5,833,524 A * 11/1998 Satoh et al. ..... 451/456
6,267,657 B1 * 7/2001 Tawara et al. ..... 451/456
6,524,180 B1 * 2/2003 Simms et al. ..... 454/65
7,300,337 B1 * 11/2007 Sun et al. ..... 451/295

* cited by examiner

*Primary Examiner*—Timothy V Eley
(74) *Attorney, Agent, or Firm*—Wang Law Firm, Inc.; Li K. Wang

(57) ABSTRACT

A grinding machine with a length-adjustable dust collecting structure includes a dust collecting structure, and the dust collecting structure includes a dust collecting pipe and a moving element, and the moving element is installed at a front end of the dust collecting pipe for collecting dusts produced after a grinding process, and the moving element can be pushed or retracted from the front end of the dust collecting pipe, such that the displacement of the moving element at the front end of the dust collecting pipe allows the dust collecting pipe to effectively suck the dusts produced during the grinding process.

9 Claims, 7 Drawing Sheets

GRINDING MACHINE WITH A LENGTH-ADJUSTABLE DUST COLLECTING STRUCTURE

BACKGROUND OF THE INVENTION

1. Field of the Invention

The present invention relates to a grinding machine, and more particularly to a grinding machine with a length-adjustable dust collecting structure for collecting dusts produced in a grinding process and preventing the dust from affecting the grinding work.

2. Description of the Related Art

Dusts are usually produced during a process of grinding a work piece by a grinding machine, and thus it is necessary to collect the dusts. In general, the dust collection methods include using a waste gas discharged from the grinding machine to guide and discharge the dusts into a specific dust collecting bag, or connecting a vacuum cleaner to the grinding machine for sucking and removing the dusts.

Referring to FIG. 7 for the grinding machine that can guide and discharge dusts, the grinding machine includes a dust collecting pipe for sucking the dusts produced during a grinding process. The grinding machine also includes a driving axle connected to a grinding element, a dust collecting opening disposed at an end of the dust collecting pipe and corresponding to the grinding element, and a dust discharging opening disposed at another end of the dust collecting pipe, such that the dusts produced during the manufacture can be collected.

Although the grinding machine 9 can achieve the dust collecting effect, some dusts still fall outside the dust collecting opening and not all dusts can be connected successfully due to different manufacturing conditions (such as the appearance of the work piece and the limitation of the environment) and the fixed design of the dust collecting opening of the dust collecting pipe.

In view of the foregoing shortcomings of the prior art, a design of the dust collecting pipe is provided for effectively sucking and collecting dusts produced during the manufacture and coping with different manufacturing conditions.

SUMMARY OF THE INVENTION

In view of the shortcomings of the prior art, the inventor of the present invention based on years of experience in the related industry to conduct extensive researches and experiments, and finally developed a grinding machine with a length-adjustable dust collecting structure in accordance with the present invention.

Therefore, it is a primary objective of the present invention to overcome the shortcomings of the prior art by providing a grinding machine with a length-adjustable dust collecting structure with a design of pushing or retracting the moving element from the front end of the dust collecting pipe, so that the grinding machine can cope with different manufacturing conditions (such as the appearance of the work piece and the limitation of the environment) and effectively suck and collect the dusts produced during the grinding process.

A secondary objective of the present invention is to overcome the aforementioned shortcomings by providing a grinding machine with a length-adjustable dust collecting structure, such that the dust collecting structure can suck and collect the dusts produced during a grinding process, and the moving element is prevented from touching the work piece that will cause a temporary suspension of the grinding work.

Another objective of the present invention is to overcome the aforementioned shortcomings by providing a grinding machine with a length-adjustable dust collecting structure, wherein the structure simply requires a simple switch to change the position of the moving element with respect to the dust collecting pipe in order to cope with different manufacturing conditions.

To achieve the foregoing objectives, the present invention provides a grinding machine with a length-adjustable dust collecting structure, and the grinding machine comprises a control portion and a driving axle, and an axis of the driving axle is disposed horizontally at a side of the control portion, and the grinding machine includes a dust collecting structure, characterized in that: the dust collecting structure includes a dust collecting pipe and a moving element, and the dust collecting pipe is installed on a side of the grinding machine and comes with a front end and a rear end, and the moving element is installed at the front end of the dust collecting pipe, and the moving element can slide on the dust collecting pipe for pushing or retracting the moving element from the front end of the dust collecting pipe.

The above and other objects, features and advantages of the present invention will become apparent from the following detailed description taken with the accompanying drawing.

DETAILED DESCRIPTION OF THE PREFERRED EMBODIMENTS

Referring to FIGS. 1 to 6 for structures in accordance with preferred embodiments of the present invention, the embodiments are provided for the purpose of illustrating the invention only, but not intended to limit the invention.

Figure 1:
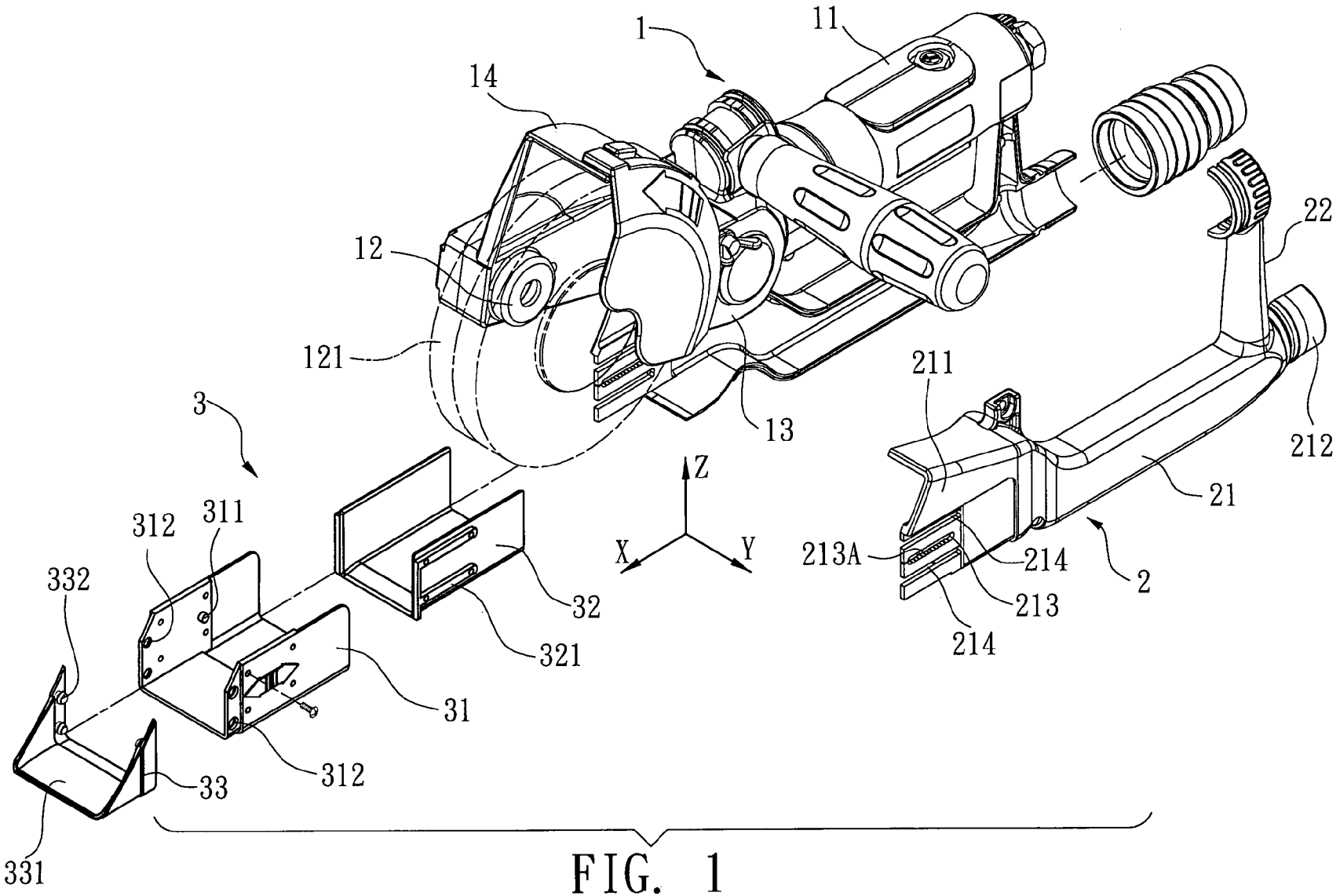
FIG. 1 is an exploded view of a portion of the present invention.
Figure 2:
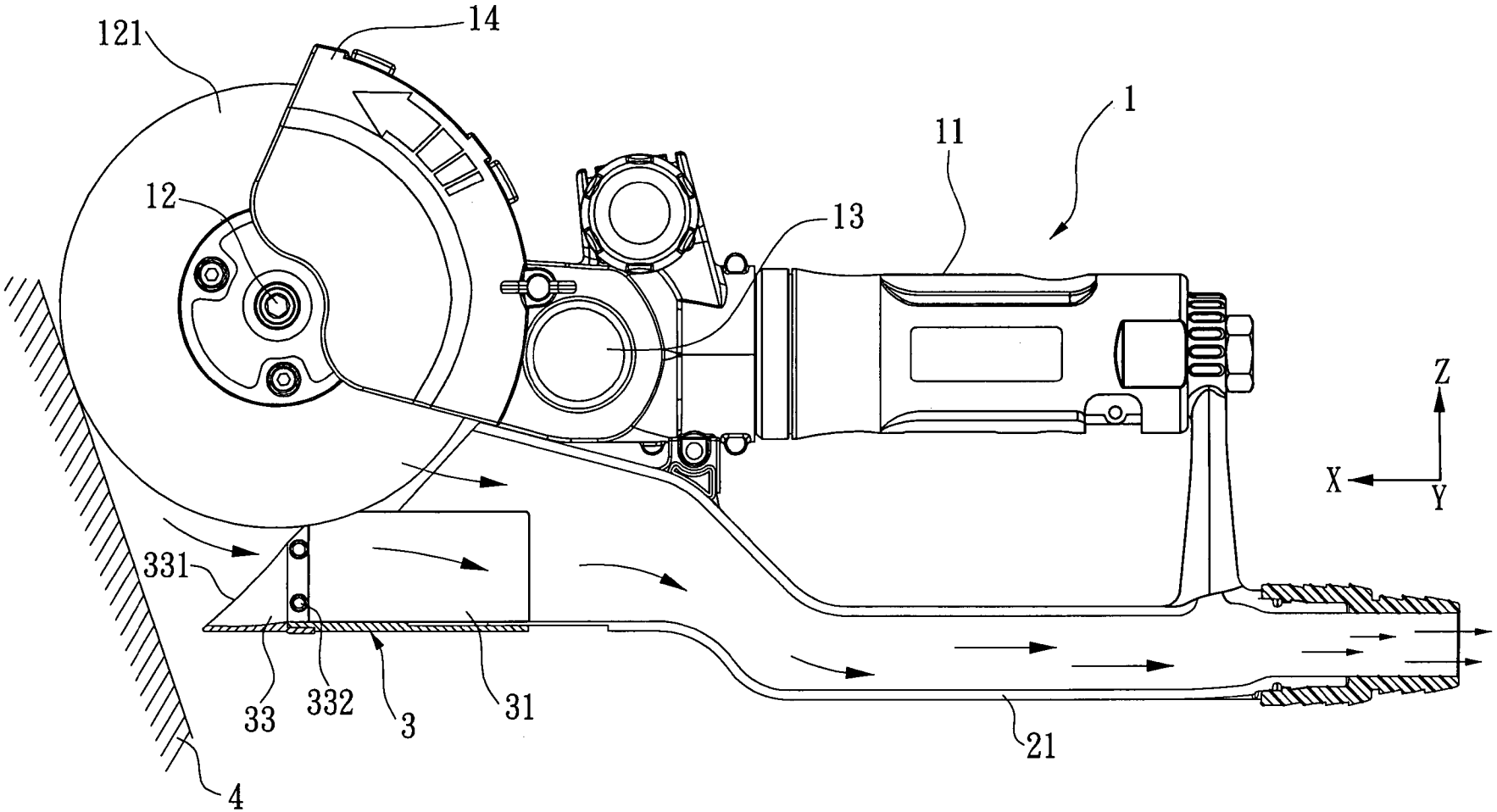
FIG. 2 is a cross-sectional view of a portion of the present invention.

In FIGS. 1 and 2, the invention provides a grinding machine with a length-adjustable dust collecting structure, and the grinding machine 1 comprises a rod-shaped control portion 11 for users to hold, a driving axle 12 with an axis horizontally situated on a side of the control portion 11, and connected with the control portion 11 through a connecting portion 13. In this embodiment, the Y-axis of the driving axle 12 is perpendicular to the X-axis of the control portion 11, and the Y-axis of the driving axle 12 is extended horizontally towards a side of the control portion 11, and the driving axle 12 installs a grinding element 121, and the connecting portion 13 installs a protecting cover 14 for the protection.

The grinding machine 1 includes a dust collecting structure 2, and the dust collecting structure 2 includes: a dust collecting pipe 21 and a moving element 3, and the dust collecting pipe 21 is installed on a side of the grinding machine 1 and comes with a front end 211 and a rear end 212. In this embodiment, the dust collecting pipe 21 is installed at the bottom of the grinding machine 1, and the dust collecting pipe 21 is connected to the grinding machine 1 through a connecting base 22.

Figure 3:
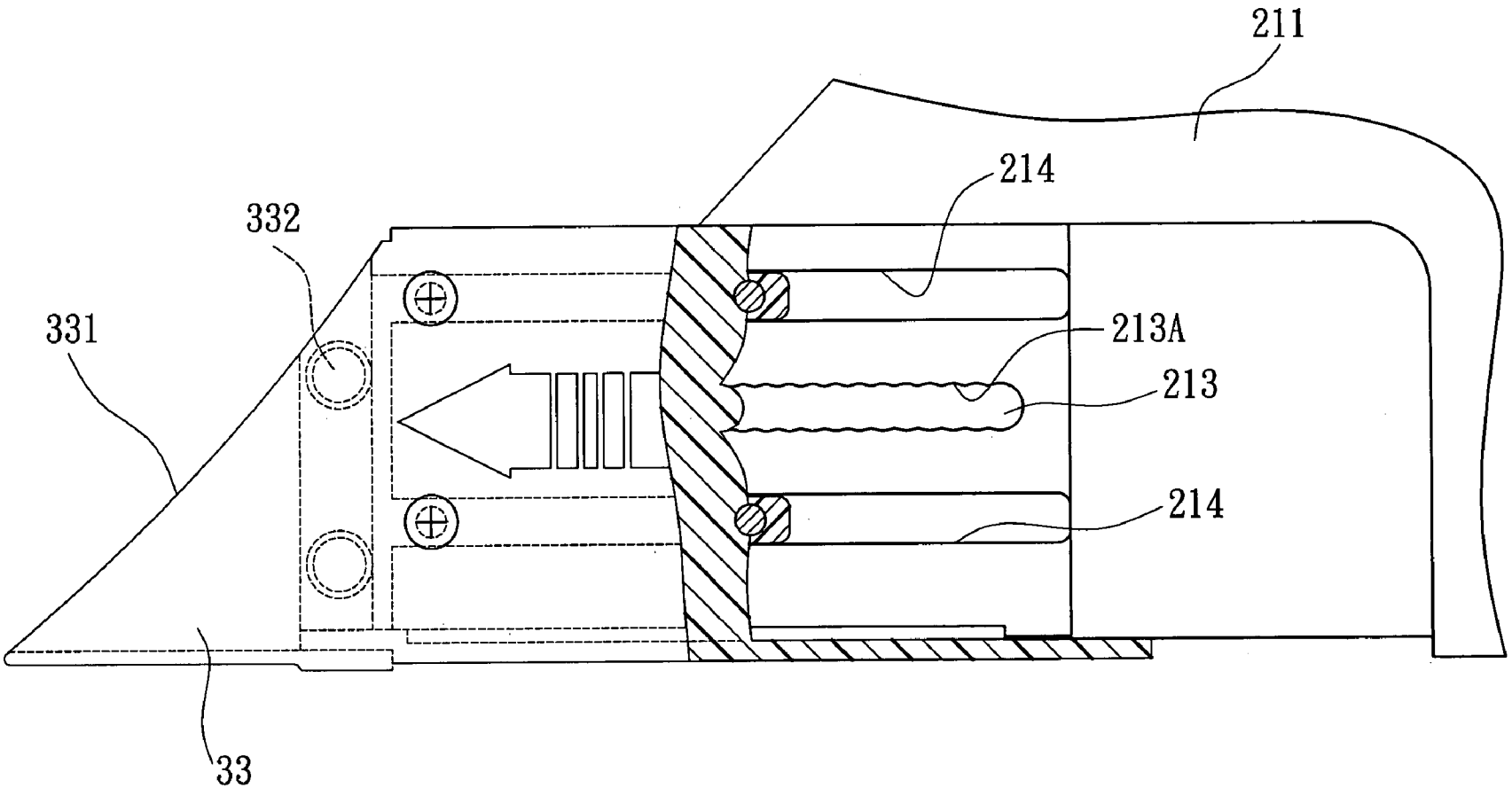
FIG. 3 is a schematic view of sliding a moving element linearly in accordance with the present invention.
Figure 4:
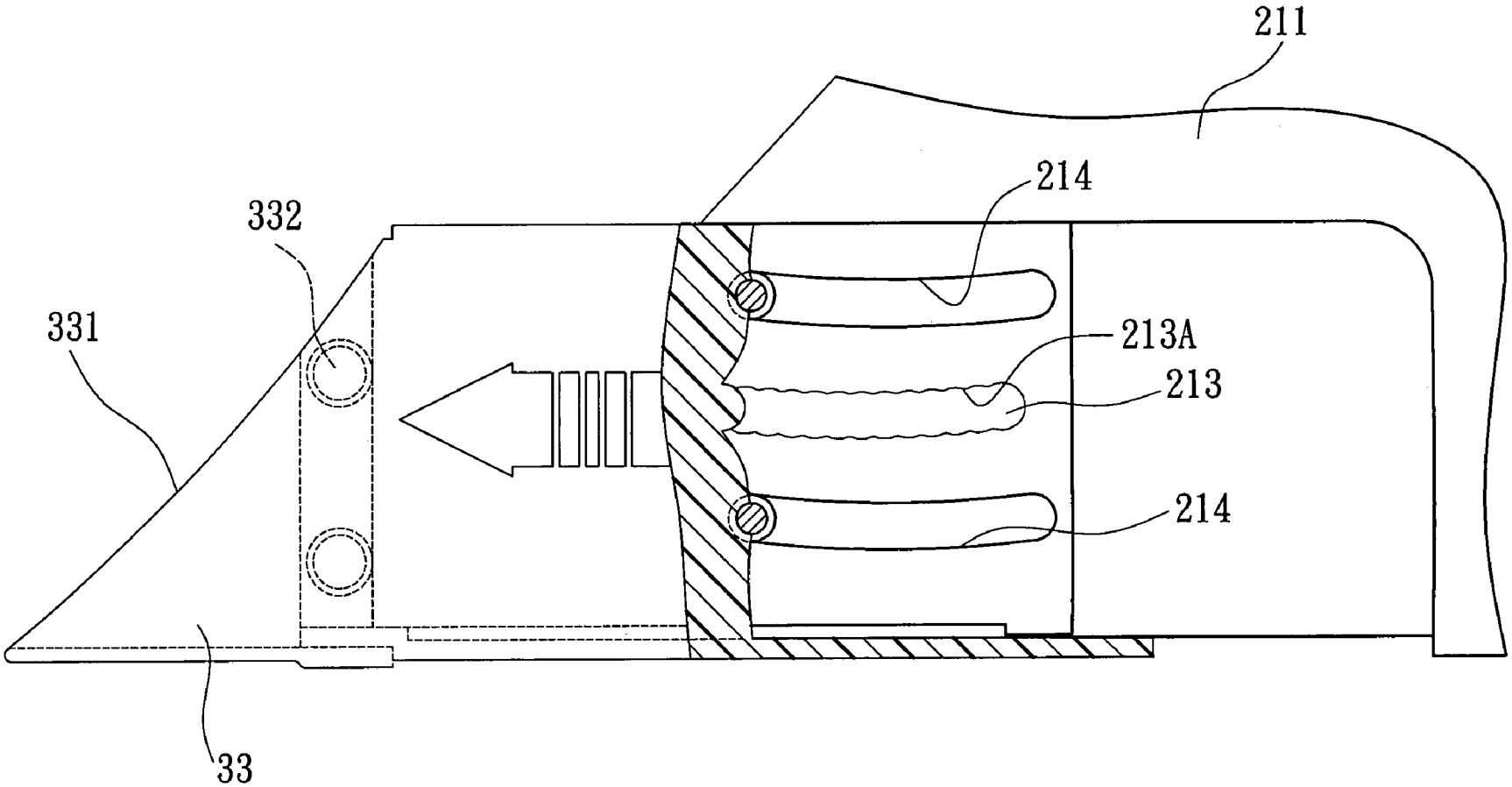
FIG. 4 is a schematic view of sliding a moving element in a curved line in accordance with the present invention.

The moving element 3 is installed at the front end 211 of the dust collecting pipe 21, and the moving element 3 can slide with respect to the dust collecting pipe 21, such that the moving element 3 is pushed or retracted from the front end 211 of the dust collecting pipe 21. In this embodiment, the moving element 3 includes a slide cover 31 installed at the front end 211 of the dust collecting pipe 21, and the slide cover 31 includes a positioning pillar 311 disposed separately on internal edges of both sides of the slide cover 31, and the dust collecting pipe 21 includes a slide groove 214 disposed separately on internal edges of both sides of the slide cover 31 corresponding to the positioning pillars 311, and each slide groove 213 comes with an open end and a closed end, and each slide groove 213 is provided for inserting one of the respective positioning pillars 311, and each slide groove 213 includes a serrated slide rail 213A for positioning the positioning pillar 311 of the slide cover 31, and each the slide groove 213 is aligned linearly or in a curve line with the slide rail 213A as shown in FIGS. 3 and 4 respectively, such that the slide cover 31 can slide along the slide rail 213A of the slide groove 213 linearly or in a curved line.

In the present invention, the moving element 3 further comprises a dust resisting plate 32 for preventing dusts from falling into the slide rail 213A of the slide groove 213, and also preventing the moving element 3 from being unable to slide on the dust collecting pipe 21 due to the dusts. The front end 211 of the dust collecting pipe 21 has a plurality of open positioning slot 214, and the dust resisting plate 32 has a plurality of positioning lumps 321 corresponding to the positioning slots 214, and each of the positioning lumps 321 is inserted into each corresponding positioning slot 214, and moved back and forth in each corresponding positioning slot 214. In this embodiment, each positioning slot 214 is installed separately at the top and the bottom of each the slide groove 213, and the dust resisting plate 32 includes two positioning lumps 321 disposed separately on external edges of both sides of each positioning slot 214. The slide cover 31 is engaged with the external periphery of the dust collecting pipe 21, and the dust resisting plate 32 is installed at the internal periphery of the front end 211 of the dust collecting pipe 21, and the slide cover 31 is secured onto the positioning lump 321 of the dust resisting plate 32 by a plurality of screws, and the dust resisting plate 32 can slide together with the slide cover 31 on the dust collecting pipe 21. With each positioning lump 321 of the dust resisting plate 32 and each positioning slot 214 of the dust collecting pipe 21, the moving element 3 can slide on the dust collecting pipe 21 stably without any vibration.

In the present invention, the moving element 3 further includes a rubber stop plate 33 extended and protruded outward from the rubber stop plate 33, and an end of the rubber stop plate 33 is fixed to the slide cover 31, and another end of the rubber stop plate has a dust collecting opening 331 for collecting the dusts produced during a grinding process, and both sides of the slide cover 31 have two holes 312 each, and the rubber stop plates 33 have two rubber protrusions 332 disposed at positions corresponding to the holes 312 on both sides of the slide cover 31, and each rubber protrusion 332 installed in a direction towards the hole 312 of the slide cover 31 and inserted into each respective hole 312 for positioning the rubber stop plate 33 at the front end of the slide cover 31.

During the use of the grinding machine 1, the driving axle 12 drives the grinding element 121 to rotate and grind a work piece 4. During the grinding process, the grinding element 121 rubs the work piece 4 to produce dusts, and the dusts will eject together with the inertia of the fast moving grinding element 121 along the tangential direction of the grinding element 121 and fall off. With the design of the dust collecting structure 2, the dusts produced during the grinding process are sucked by the suction at the dust collecting opening 331 into the of the dust collecting pipe 21 through the dust collecting opening 331 and discharged to a dust collection area (not shown in the figure).

Figure 5:
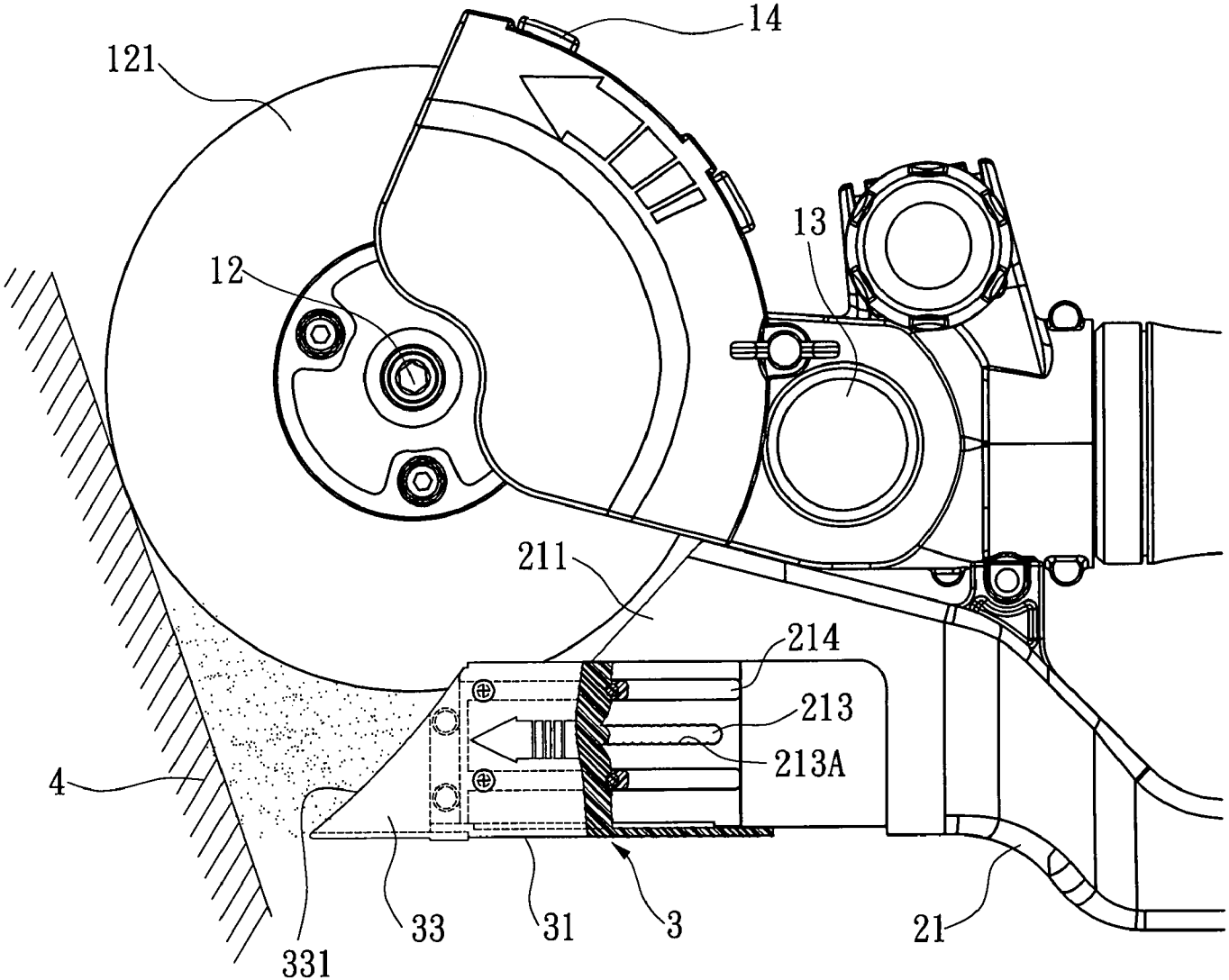
FIG. 5 is a schematic view of pushing a moving element in accordance with the present invention.
Figure 6:
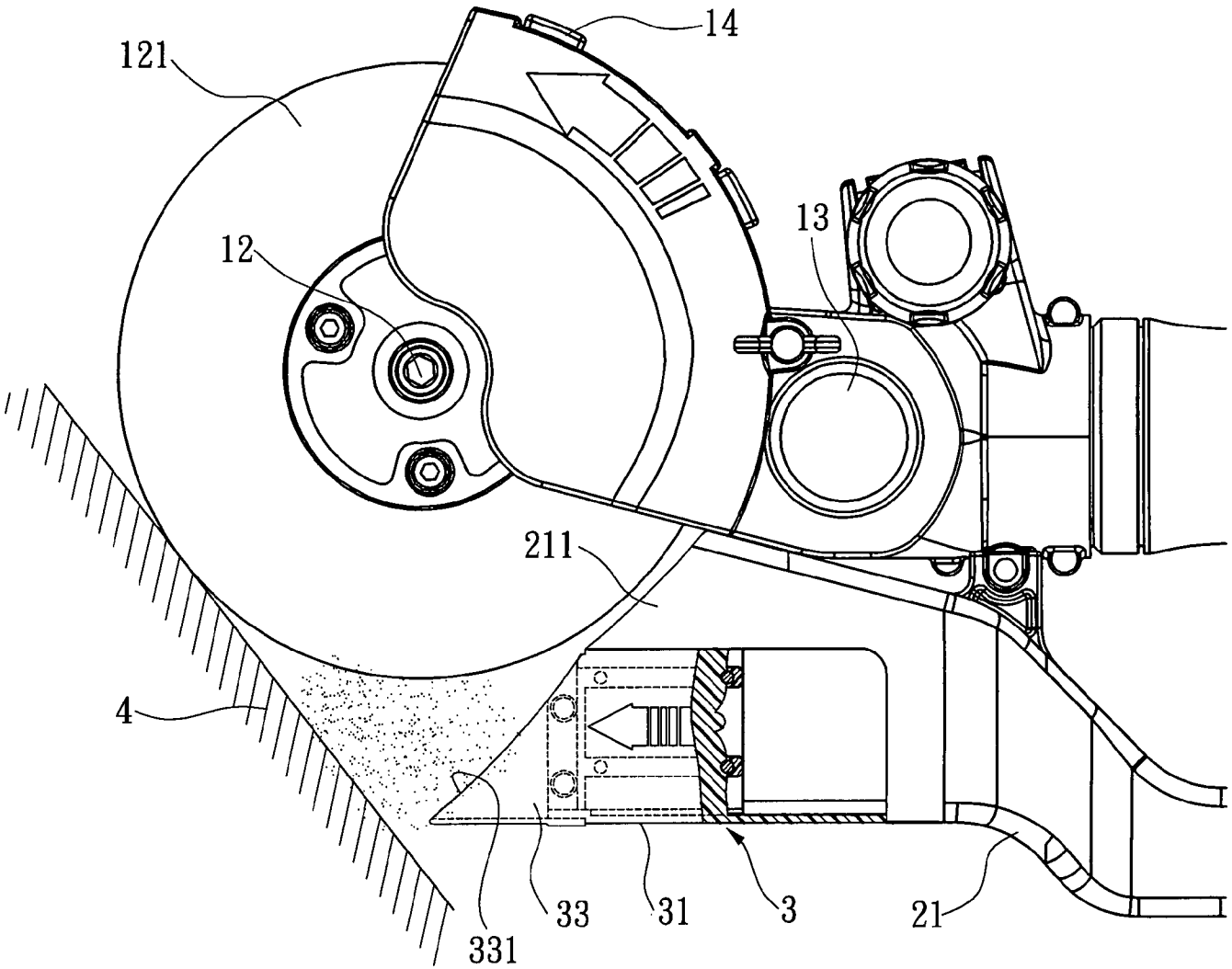
FIG. 6 is a schematic view of retracting a moving element in accordance with the present invention.
Figure 7:
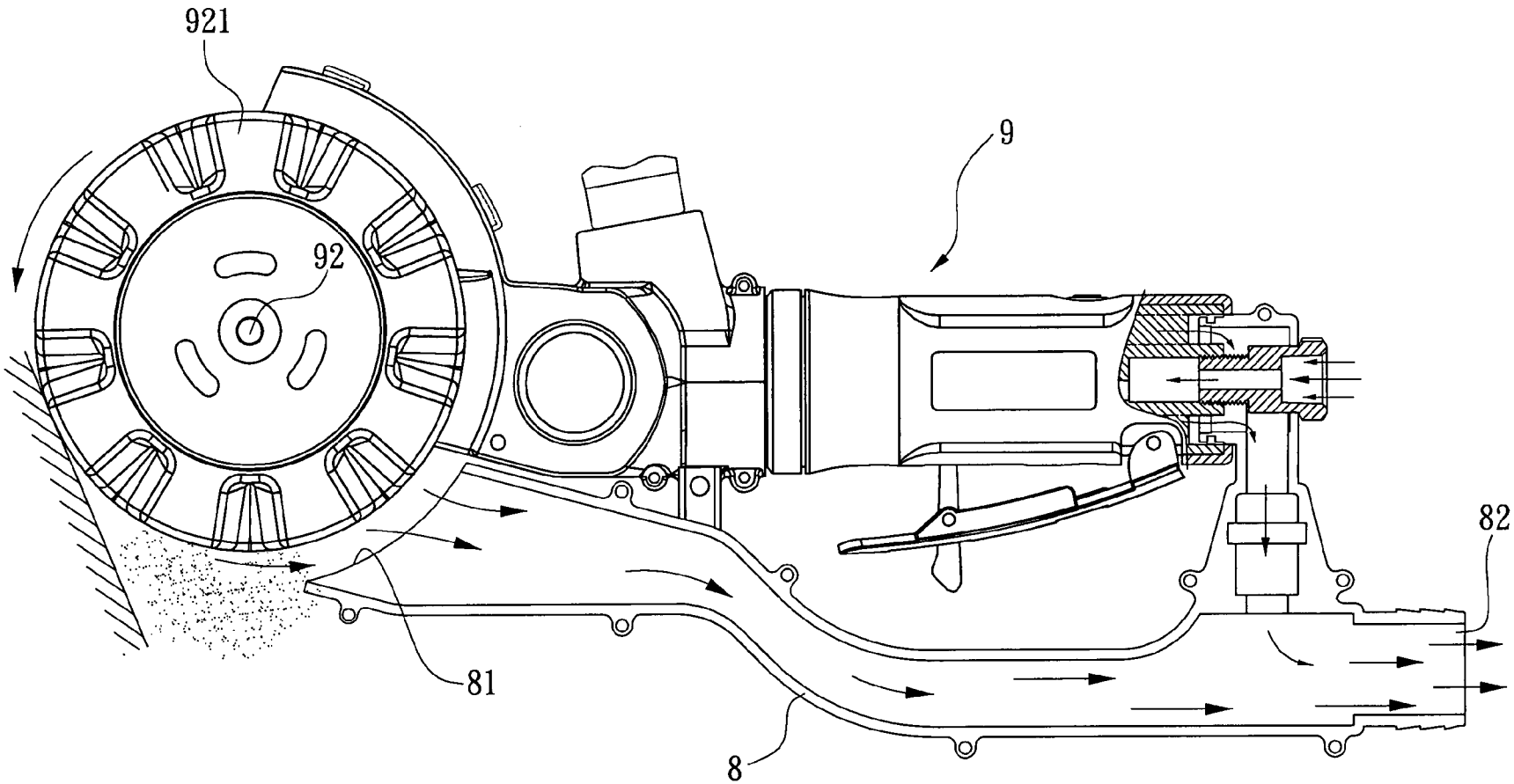
FIG. 7 PRIOR ART
FIG. 7 is a schematic view of using a prior art grinding machine.

Referring to FIGS. 5 and 6 for illustrating the dust collecting structure 2 being used in different manufacturing conditions (such as the appearance of the work piece and the limitation of the environment), the moving element 3 is pushed out from the front end of the dust collecting pipe 21 as shown in FIG. 5, such that the dust collecting structure 2 is extended further. Such advantage allows the dusts to be collected completely without falling outside the dust collecting structure 2. In FIG. 6, the moving element 3 is retracted from the front end 211 of the dust collecting pipe 21 to prevent the moving element 22 from touching the work piece 4 that will cause a temporary suspension of the grinding manufacture.

In summation of the description above, the advantages of the invention reside on that the moving element can be pushed or retracted from the front end of the dust collecting pipe, so that the grinding machine can cope with different manufacturing conditions to suck and collect the dust produced during a grinding process. Further, the dust collecting structure can suck and collect the dust produced during the grinding process, and the moving element will not contact with the work piece or cause any temporary suspension of the grinding job. With a simple switch, the relative position of the moving element with respect to the dust collecting pipe can be changed.

What is claimed is:

1. A grinding machine with a length-adjustable dust collecting structure, comprising a control portion and a driving axle, and an axis of the driving axle being horizontally disposed on a side of the control portion, and the grinding machine having a dust collecting structure, characterized in that:

the dust collecting structure includes a dust collecting pipe and a moving element, and the dust collecting pipe is installed on a side of the grinding machine and has a front end and a rear end, and the moving element is installed at the front end of the dust collecting pipe, and the moving element is configured to slide on the dust collecting pipe, wherein the moving element includes a slide cover installed at the front end of the dust collecting pipe, wherein the slide cover includes a positioning pillar disposed separately on internal edges on both a first side and a second side of the slide cover, and the dust collecting pipe includes a slide groove disposed separately on internal edges on both sides of the dust collecting pipe and corresponding to the slide cover for inserting each of the positioning pillars.

2. The grinding machine with a length-adjustable dust collecting structure of claim 1, wherein the slide groove of the dust collecting pipe comes with an open end and a closed end, and the slide groove further includes a serrated slide rail.

3. The grinding machine with a length-adjustable dust collecting structure of claim 2, wherein the slide groove is aligned with the slide rail.

4. The grinding machine with a length-adjustable dust collecting structure of claim 2, wherein the slide groove and the slide rail are aligned in a curved line.

5. The grinding machine with a length-adjustable dust collecting structure of claim 1, wherein the moving element further includes a dust resisting plate installed on the internal periphery of the front end of the dust collecting pipe, and the dust resisting plate together with the slide cover can be pushed or retracted at the front end of the dust collecting pipe.

6. The grinding machine with a length-adjustable dust collecting structure of claim 5, wherein the dust collecting pipe includes a plurality of positioning slots, and the dust resisting plate includes a plurality of positioning lumps corresponding to the respective positioning slots, and each positioning lump is inserted into each respective positioning slot to slide within each respective positioning slot.

7. The grinding machine with a length-adjustable dust collecting structure of claim 1, wherein the moving element further includes a rubber stop plate extended and protruded outward from the slide cover.

8. A grinding machine with a length-adjustable dust collecting structure, comprising a control portion and a driving axle, and an axis of the driving axle being horizontally disposed on a side of the control portion, and the grinding machine having a dust collecting structure, characterized in that:

the dust collecting structure includes a dust collecting pipe and a moving element, and the dust collecting pipe is installed on a side of the grinding machine and has a front end and a rear end, and the moving element is installed at the front end of the dust collecting pipe, and the moving element is configured to slide on the dust collecting pipe, wherein the moving element further includes a dust resisting plate installed on the internal periphery of the front end of the dust collecting pipe, and the dust resisting plate together with the slide cover can be pushed or retracted at the front end of the dust collecting pipe, wherein the dust collecting pipe includes a plurality of positioning slots, and the dust resisting plate includes a plurality of positioning lumps corresponding to the respective positioning slots, and each positioning lump is inserted into each respective positioning slot to slide within each respective positioning slot.

9. A grinding machine with a length-adjustable dust collecting structure, comprising a control portion and a driving axle, and an axis of the driving axle being horizontally disposed on a side of the control portion, and the grinding machine having a dust collecting structure, characterized in that:

the dust collecting structure includes a dust collecting pipe and a moving element, and the dust collecting pipe is installed on a side of the grinding machine and has a front end and a rear end, and the moving element is installed at the front end of the dust collecting pipe, and the moving element is configured to slide on the dust collecting pipe, wherein the moving element further includes a rubber stop plate extended and protruded outward from the slide cover.

* * * * *